US005263534A

United States Patent [19]

Ichikawa et al.

[11] Patent Number: 5,263,534

[45] Date of Patent: Nov. 23, 1993

[54] EXOTHERMIC TYPE MOLD ADDITIVES FOR CONTINUOUS CASTING

[75] Inventors: Kenji Ichikawa, Okayama; Osamu Nomura; Akihiro Morita, both of Bizen; Hideaki Fujiwara, Kurashiki; Shinji Hattori, Bizen, all of Japan

[73] Assignee: Shinagawa Refractories Co., LTd., Tokyo, Japan

[21] Appl. No.: 809,550

[22] PCT Filed: Jul. 19, 1991

[86] PCT No.: PCT/JP91/00967

§ 371 Date: Jan. 30, 1992

§ 102(e) Date: Jan. 30, 1992

[87] PCT Pub. No.: WO92/09386

PCT Pub. Date: Jun. 11, 1992

[30] Foreign Application Priority Data

Nov. 30, 1990 [JP] Japan ..... 2-330463

[51] Int. Cl.[5] ..... B22D 11/10

[52] U.S. Cl. ..... 164/473; 164/55.1; 164/56.1; 75/305

[58] Field of Search ..... 164/473, 55.1, 56.1; 75/305, 328, 303

[56] References Cited

U.S. PATENT DOCUMENTS

| | | | |
|---|---|---|---|
| 3,937,269 | 2/1976 | Salvadore et al. | 164/473 |
| 4,168,966 | 9/1979 | Furui et al. . | |
| 4,204,864 | 5/1980 | Loane, Jr. et al. | 164/473 |
| 4,290,809 | 9/1981 | Loane, Jr. . | |
| 4,508,571 | 4/1985 | Nakato et al. | 164/473 |

FOREIGN PATENT DOCUMENTS

| | | | |
|---|---|---|---|
| 48-97735 | 12/1973 | Japan . | |
| 53-70039 | 6/1978 | Japan . | |
| 57-7211 | 2/1982 | Japan . | |
| 58-154445 | 9/1983 | Japan . | |
| 169498 | 4/1984 | Japan . | |
| 146699 | 3/1985 | Japan . | |
| 035335 | 9/1985 | Japan . | |
| 043810 | 9/1985 | Japan . | |
| 132076 | 1/1986 | Japan . | |
| 61-27150 | 2/1986 | Japan . | |
| 64-66056 | 3/1989 | Japan . | |
| 1-104452 | 4/1989 | Japan . | |
| 0515430 | 5/1976 | U.S.S.R. | 164/473 |
| 0638620 | 12/1978 | U.S.S.R. | 164/473 |
| 792023 | 3/1958 | United Kingdom . | |
| 1230094 | 4/1971 | United Kingdom . | |
| 1243837 | 8/1971 | United Kingdom . | |
| 1301172 | 12/1972 | United Kingdom . | |
| 1385810 | 2/1975 | United Kingdom . | |
| 1465635 | 2/1977 | United Kingdom . | |

*Primary Examiner*—Mark Rosenbaum
*Assistant Examiner*—Erik R. Puknys
*Attorney, Agent, or Firm*—Wenderoth, Lind & Ponack

[57] ABSTRACT

An exothermic type mold additive for continuous casting comprising 20~90 wt % base raw materials, 0~10 wt % silicious raw materials containing more than 50 wt % $SiO_2$ content, 0~20 wt % flux raw materials, 2~30 wt % of more than one kind selected from a group comprising carbonates, bicarbonates and nitrates of alkaline metals as exothermic materials, and 3~30 wt % of more than one kind of component selected from a group comprising carbon, silicon and silicon alloys as reducing materials. Oxidation exothermic speed is controlled by controlling the kind and amounts of reducing materials, and casting with few carburization, inclusions, pin-holes, etc. can be obtained.

3 Claims, No Drawings

EXOTHERMIC TYPE MOLD ADDITIVES FOR CONTINUOUS CASTING

FIELD OF TECHNOLOGY

The present invention relates to an exothermic type mold additive for continuous casting in which exothermic properties are imparted to the mold additive for continuous casting of steel. Further, the present invention relates to an exothermic type mold additive for continuous casting of steel, specifically to a mold additive which is able to reduce carburization in a product cast piece and further to reduce surface defects of the product such as inclusions, pinholes, etc.

BACKGROUND OF THE INVENTION

Mold additives for continuos casting of steel are added onto the surface of molten steel poured into a mold to form by receiving heat from the molten steel a layer structure above the molten steel surface, of a fused slag layer, a sintered layer and an unfused original mold additive layer, and then be consumed while gradually performing various duties. Its main role may be exemplified by the provision of:

(1) a lubricating action between the mold and a solidified shell;

(2) a melting and absorbing action of inclusions which float from inside of the molten steel; and (3) a heat insulating action of the molten steel and the like are exemplified.

Recently, progress in continuous casting technology of steel has been remarkable and the demands on mold additives which have an influence on cast-piece qualities and operation stabilities have become even more strict, so that the quality of mold additives have been designed to accomodate various steel components and casting conditions.

Among the roles of mold additives (1) and (2) described above, are most important in controlling the characteristics of the mold additive such as softening point, viscosity, etc., so that selection of the chemical composition is important.

On the other hand, for heat insulation of the molten steel of (3), melting speed which is controlled by carbonaceous raw materials and powder characteristics such as bulk density, spreadability, etc. are important.

Even more recently, an exothermic type front mold additive in which molten steel temperatures at a meniscus portion in the mold are secured by improving (3) a step further and in order to improve the quality of castings, metal exothermic materials such as Ca-Si, Al, etc. are included in the mold additive to supply heat to the molten steel by generating exothermic reactions from oxidation in the mold, and then promptly fusing after the reaction to show the same behavior as a normal mold additive after fusing, has become desirable. Further, an exothermic type mold additive for the main has also been desired. Here, front mold additive means a mold additive which is used during irregular casting (at the beginning of casting, during tundish exchange) and main mold additive means a mold additive which is used during regular casting.

However, as it is necessary for an exothermic mold additive not only to obtain heat by exothermic reactions, but also to achieve the original duties of a mold additive after exothermic reactions as described above, various problems in quality design still remain.

When quality designing for a practical exothermic type mold additive for continuous casting, it is necessary to satisfy each of the following 3 items:

(i) that active additives not be contained in consideration of safety at the time of production, storage and use;

(ii) that exothermic reactions which can supply sufficient calorific value be obtained rapidly and uniformly without leaving unreacted substances, and that the calorific value, flame generating amounts, etc. can be controlled according to casting conditions when used; and (iii) that exothermic reaction products rapidly form a fused glass layer, and be consumed by succesively flowing in between a mold and a solidified shell.

Up to now various exothermic mold additives have been proposed, however, there is no mold additive which satisfies the 3 items described above.

For instance, in Japanese Patent Laid Open No. 48-97735 a mold additive in which silicon, ferrosilicon and calcium-silicon are added as exothermic substances has been disclosed. This document discloses that these exothermic substances act as slag control agents on the one hand and that combustion heat can be obtained by the reaction with oxygen in the atmosphere on the other.

However, as metal powder which is added as an exothermic substance becomes an oxide for the first time by reacting in a solid or liquid state after being fused with oxygen in the atmosphere and then absorbed in the fused mold additive slag, various problems accur easily. Namely, at present, where gas blowing from a refractory for continuous casting has become common knowledge, as blown in gases such as argon, etc. enter into a mold and float into a mold additive, metal oxidation speed does not stabilize, so unreacted metal remains to be easily drawn into the fused mold additive slag or molten steel to obstruct the lubrication properties of the mold additive slag film. On the other hand, since this becomes a cause of quality deterioration of the castings as unreacted metal is picked up into steel to be the cause of inclusions and the like, it is not practical.

In Japanese Patent Laid Open Nos. 53-70039 and 58-154445, the addition of aluminum, aluminum alloys, calcium, and calcium alloys have been disclosed, however, as these additives include an active substance, they are not practical in view of (i) above.

Further, although Japanese Patent Publication No. 57-7211 proposes a mold additive in which a Ca-Si alloy is formulated, its exothermic reaction is not specifically described, but judging from its Examples, it is based on a method in which combustion heat is obtained by reaction of metal with oxygen in the atmosphere, it has drawbacks similar to the techniques described in Japanese Patent Laid Open No. 48-97735, so that it is not practical from the viewpoint of (ii) and (iii).

As the molten steel viscosity of so-called extremely low carbon steel having low carbon concentration, the production of which has been increasing in recent years, is high, the supply of heat to the meniscus in a mold can easily be insufficient and inclusions and gases which float from the inside of the molten steel can easily be caught by formation of an unsound solidified shell. As the captured inclusions and gases remain as defects in castings such as pin-holes, blow-holes, slag-bite and the like, scarfing becomes necessary and it not only becomes difficult to carry out hot charge rolling (hereinafter referred to as HCR) or hot direct rolling (hereinafter referred to as HDR), but also it becomes an obstacle when plastic processing of the latter process is carried out.

Therefore, in order to form a sound initial solidified shell which does not catch inclusions, it is necessary and indispensable to control temperature lowering of the meniscus inside the mold, and the insultating action of a mold additive becomes more important than that for conventional low carbon aluminum killed steel.

Further, in extremely low carbon steel, in a process after RH vacuum degassing treatment (Rheinstahl Huetten Werke & Heraus), it is necessary to control carburization and also to control carburization caused by a mold additive to the utmost. Therefore, although for mold additives it is desirable that the carbon content be small, just lowering the carbon content causes various problems. Carbonaceous raw materials are not only used as a slag melting speed control agent of a mold additive to control fused slag layer thickness but also contribute as a mutual sintering control agent for various raw materials in an unfused original mold additive layer together with maintaining a low thermal conductivity layer, keeping warm by exothermic reactions when they are oxidized. Therefore, if carbon content is simply decreased, it contributes to control carburization, but the thermal insulating property deteriorates, not only deteriorating casting quality but also adjustment of slagging melting speed becomes difficult, the thickness of a fused slag layer becomes too thick and sometimes it causes operational problems.

As described above, a mold additive for extremely low carbon steel which does not cause carburization and also has excellent thermal insulating properties is indispensable. However, it is presently true that a practical finished product has not been completed.

For instance, it has been disclosed in Japanese Patent Laid Open No. 64-66056 to use strong reducing substances such as metal, etc. in order to decrease carbon content to less than 1%. However, as oxidation exothermic reactions of added strong reducing substances depend on air oxidation and further because slagging speed is controlled thereby, under present conditions in which gas blowing from a refractory for continuous casting has become general knowledge, because argon gases enter into a mold to float to the surface, it is difficult to stabilize the oxidation speed of the strong reducing substances. Therefore, as stable exothermic reactions cannot be obtained and further, since unreacted additives remain and can be easily mixed into the fused mold additive slag or molten steel to obstruct the lubricating properties of the mold additive slag film, causing contamination of unreacted substances into the steel, becoming the origin of inclusions, etc. they accordingly become the cause of quality deterioration of castings so that they are not practical.

DISCLOSURE OF THE INVENTION

The present inventors, as a result of a number of investigations to resolve the problems described above, found that all of the drawbacks of conventional exothermic mold additives described above can be overcome.

Namely, in one aspect of the present invention an exothermic mold additive for continuous casting is provided characterized in that it comprises 20~90 wt % base raw materials, 0~10 wt % silicious raw materials containing more than 50 wt % $SiO_2$ content, 0~20 wt % flux raw materials, 2~30 wt % of more than one kind of component selected from a group comprising carbonates, bicarbonates and nitrates of alkaline metals as exothermic materials, and 3~30 wt % of more than one kind of component selected from a group comprising carbon, silicon and silicon alloys as reducing materials.

Another aspect of the present invention provides an exothermic mold additive for continuous casting characterized in that it comprises 20~90 wt % base raw materials, 0~10 wt % silicious raw materials containing more than 50 wt % $SiO_2$ content, 0~20 wt % flux raw materials, 2~30 wt % of more than one kind of component selected from a group comprising carbonates, bicarbonates and nitrates of alkaline metals as exothermic materials, wherein inevitable free carbon is less than 0.5 wt %.

Further, in one other aspect, the present invention provides an exothermic mold additive for continuous casting characterized in that it comprises 30~90 wt % base raw materials, 0~15 wt % silica containing more than 50 wt % $SiO_2$ content, 0~20 wt % flux raw materials, 2~30 wt % of more than one kind of component selected from a group comprising carbonates, bicarbonates and nitrates of alkaline metals as exothermic materials, 0.5~5 wt % carbonaceous raw materials, and 1~20 wt % silicon or silicon alloys or both thereof as reducing materials.

In a further aspect, the present invention provides an exothermic mold additive for continuous casting characterized in that it contains 0~30 wt % of flame control materials comprising iron oxides.

Drawbacks which most conventional exothermic mold additives have are that most exothermic sources depend on heat of reaction between metal being an exothermic material and oxygen in the atmosphere or other oxidizing materials.

To overcome this drawback, in the exothermic mold additive for continuous casting of the present invention, more than one kind of component selected from a group comprising carbonates, bicarbonates, and nitrates of alkaline metals, and more than one kind of component selected from a group comprising carbon, silicon, and silicon alloys as reducing materials are used. For this reason, in the present invention, the oxidizing speed of added metal raw materials and carbonaceous raw materials can be controlled so that slagging proceeds smoothly. Further, in low carbon steel, by controlling components of these reducing materials, new exothermic systems which tend to make carburization difficult have been found.

Namely, when the exothermic mold additives for continuous casting are charged into a mold, in addition to said exothermic materials being able to rapidly react with said reducing materials to obtain heat of exothermic reaction by oxidation of the reducing materials, alkaline metals, for instance, sodium gases are produced by reduction of the exothermic materials and further, these sodium gases may be made to react with oxygen in the atmosphere to rapidly obtain a large amount of combustion heat.

In the mold additives for continuous casting of the present invention, as reactions between the exothermic materials and the reducing materials are remarkably fast, and as oxidation of alkaline metals, for instance, of sodium is a reaction between gases, reaction speed is fast and can be stably obtained, so that the drawbacks described above can be overcome.

It is desirable to add exothermic materials and reducing materials in the range of 3~30 wt % respectively. If the amounts added are less than 3 wt %, heat of reaction is small and ineffective. If the amounts added exceed 30 wt %, the exothermic amount becomes excessive to deteriorate workability by generating large flames making it difficult to see inside the mold etc., so this is also not preferable.

Next, in regard to the reaction between $SiO_2$ and $Na_2CO_3$, $SiO_2$ has been known to promote the decomposition of $Na_2CO_3$ as described in a report on page 52~60 of *Iron Manufacture Research*, No. 299, 1970 and as $SiO_2$ has been added into a normal mold additive as a controlling material for basicity, the inventors investigated the effects of $SiO_2$ on reaction speed between exothermic materials and reducing materials. As a result, it was understood that sodium carbonate, sodium bicarbonate and sodium nitrate preferentially react with $SiO_2$ to produce $xNa_2O.ySiO_2$ if plenty of $SiO_2$ type raw materials are present, so that it becomes difficult to produce a reducing reaction by reducing materials, and to obtain heat by combustion of sodium gas, it is necessary to restrict the content of $SiO_2$ type raw materials with an $SiO_2$ content of more than 50 wt % to less than 10 wt %.

In an embodiment of the exothermic system of the present invention, carbonaceous raw materials act as a reducing material, which react with an exothermic material and are oxidized on the one hand, and play the role of lowering oxygen partial pressure of the original mold additive layer and a sintered layer on the other. Namely, due to the oxygen partial pressure of the original mold additive layer and the sintered layer being low, an oxide layer of $SiO_2$ in not formed on the surface and SiO gas is formed in an oxidizing process of silicon or a silicon alloy, a fresh metal face always being exposed on the surface and oxidizing reaction proceeding smoothly and rapidly.

The amounts of exothermic materials added are desirably in the range of 2~30 wt %. If the added amounts are less than 2 wt %, the reaction heat is small with no effect. If the amounts exceeds 30 wt %, the exothermic amounts become too great with big flame generation, which is not preferable. Further, after completion of exothermic reaction the exothermic material acts as a fused flux.

As for reducing materials, carbon, silicon or a silicon alloy or a mixture thereof may be used. However, when extremely low carbon steel is required, it is preferably to use silicon or a silicon alloy or a mixture thereof.

Further, in order to control carburization in extremely low carbon steel, it is necessary to control carburization resulting from the mold additive as much as possible. Therefore, although it is desirable that mold additives have a small carbon content, merely decreasing the carbon content causes various problems as described above. Accordingly, in this case, it is preferable to use carbon and silicon or a silicon alloy in a controlled rate. Namely, in this case, it is preferable that the additive contain 0.5~5 wt % carbonaceous raw materials and 1~20 wt % silicon or a silicon alloy or a mixture thereof as reducing materials. In this case, amounts of the carbonaceous raw material to be added are desirably in the range of 0.5~5 wt %. If the amounts are less than 0.5 wt %, oxygen partial pressure of the unfused layer and sintered layer is not lowered and it is difficult for oxidation of silicon and the silicon alloy to proceed smoothly which is not preferable. If the amounts added exceed 5 wt %, carbon becomes excessive and unreacted solid carbon may readily remain at the interface between the sintered layer and the fused slag layer to become a cause of carburization, which is also not prefereable. Amounts of silicon or a silicon alloy or the mixture thereof to be added are preferably in the range of 1~20 wt %. If the amounts exceed 20 wt %, the flames become large, which is not preferable.

In addition to an exothermic system comprising said exothermic materials and reducing materials in accordance with use conditions such as casting conditions, etc., the mold additive of the present invention is composed of a combination of base raw materials, silica raw materials, flux raw materials, etc.

As for a base raw material, portland cement, dicalcium silicate, wollastonite, yellow phosphorus slag, blast furnace slag, synthetic calcium silicate, limestone, dolomite, magnesia, alumina, titania, etc., can be used. Particularly, the raw materials which have not been used very much conventivelly because of their endothermic reaction when decomposing such as limestone and dolomite containing $CO_2$ gas, can also be used.

Amounts of the base raw materials to be added are in the range of 20~90 wt %, preferabley 30~90 wt %. If this amount is less than 20 wt %, the amounts of other raw materials added become relatively large and cannot carry out the duties which a mold additive originally has, so that this is not preferable. If the added amounts exceed 90 wt %, the amounts of the other raw materials added become relatively small making it difficult to control such mold additive characteristics as bulk density, spreadability, etc. as well as reducing the exothermic property, which is not preferable.

Silica raw materials are used for controlling the bulk density of a mold additive and the weight ratio of $CaO/SiO_2$ of the mold additive calculated in oxide equivalents, and perlite, fly ash, silica sand, feldspar, silica powder, diatomite, sodium silicate, potassium silicate, glass powder, silica flour, etc. can be used. Amounts of the silica raw materials added are normally in the range of 0~15 wt %.

Flux raw materials are used for controlling fusion characteristics of the mold additive and the flux raw materials which are used for a normal mold additive such as sodium fluoride, cryolite, fluorite, barium carbonate, boric acid, borax, colemanite, magnesium fluoride, lithium fluoride, aluminum fluoride, manganese oxide, etc. can be used.

In a product of the present invention, as exothermic materials can carry out duties as a flux after conclusion of the reaction, amounts of the flux raw materials to be added are in the range of 0~20 wt %. If this amount exceeds 20 wt %, composition of the mold additive may be changed due to volatilization when fused or it may violently damage the immersion nozzle which is pouring molten steel into a mold, so that it is not preferable.

Further, in cases where it is desirable to control flames caused by combustion of alkaline metals such as sodium gas depending on use conditions, the flame can be controlled by adding iron oxide as a source of oxygen supply and as a flame controlling material to carry out oxidation burning the sodium gas rapidly without lowering calorific values. Namely, the iron oxide as a flame controlling material may be added within a range of below 30 wt %. If it exceeds 30 wt %, iron which was produced by reducing the iron oxide by sodium gas will not melt into the molten steel rapidly and remains in the mold additive to obstruct the original characteristics of the mold additive, so that it is not preferable.

Further, when there is a fear of carbon pick-up into steel such as extermely low carbon steel, stainless steel, etc., the pick-up of carbon can be prevented by not using carbonaceous raw material as a reducing material and controlling the amount of carbon which inevitably comes in from the other raw materials to below 0.5 wt %.

Further, an exothermic mold additive for continuous casting of the present invention may be used in the form of a powder in which said powder raw materials are mixed of in a granular state which is the result of being granulated by a method such as extruding granulation, agitating granulation, flowing granulation, rolling granulation, spraying granulation, etc.

BEST EMBODIMENT FOR PRACTICING THE INVENTION

Hereinafter, an exothermic type mold additive of the present invention will be further illustrated in detail according to the Examples.

EXAMPLES

The compositions and results after actual use of the invented products and the comparative products are described in the following Table 1. Further, other compositions and results after actual use of the invented products and the comparative products are described in the following Table 2. In Tables 1 and 2, the invented products nos. 4 and 13 are granular products in which water was added to a mixture of powder raw materials and kneaded, and then granulated into a pillar-shape by an extrusion granulator, and the others are powder products in which a powder composition was mixed with a V type mixer.

Numerals in each component column in each Table represent wt %.

In the type of steel column, the carbon contents of extremely low carbon steel, low carbon steel, middle carbon steel and stainless steel were less than 0.01%, 0.01~0.08%, 0.08~0.22%, and below 0.15% respectively.

In the column of tested amounts, try refers to the numbers of tested days and the term "ch" means the number of charges.

In result of use evaluation column, under workability:

◎ denotes good; denotes normal; Δ denotes bad; and × denotes very bad;

under exothermic properties;

◎ denotes good; denotes normal; Δ denotes bad; and × denotes very bad.

Numerals under casting inclusion index denotes a rate of generated inclusions based on the numbers of Example 1.

Numerals under casting pin-hole or blow-hole index denotes a rate of numbers generated based on the numbers of Example 11.

TABLE 1

| | Products of the invention | | | | | | | | | | Comparative products | | |
|---|---|---|---|---|---|---|---|---|---|---|---|---|---|
| | 1 | 2 | 3 | 4 | 5 | 6 | 7 | 8 | 9 | 10 | 1 | 2 | 3 |
| Composition (wt %) | | | | | | | | | | | | | |
| Base raw materials | | | | | | | | | | | | | |
| Portland cement | 20 | 35 | | | 44 | | 35 | 20 | | 50 | 40 | 47 | 47 |
| Blast furnace slag | | | 15 | | | 55 | | | 55 | | | | |
| Synthetic calcium silicate | 25 | | | 55 | | | | 50 | | | | | |
| Yellow phosphorus slag | | 10 | | | | | 20 | | | | | | |
| Limestone | | | 40 | | | | | | 15 | | | | |
| Silica type raw materials | | | | | | | | | | | | | |
| Fly ash | | | | | | 3 | | | | | 20 | | 17 |
| Quartzite | | | | | 3 | | 5 | 5 | | | | 15 | |
| Diatomite | | | | | | 2 | | | | | | | |
| Sodium silicate | | | | 5 | | | | | | | | | |
| Flux raw materials | | | | | | | | | | | | | |
| Cryolite | 6 | 5 | 10 | 10 | 6 | 10 | 5 | 10 | | | 7 | 8 | |
| Sodium fluoride | | 5 | | | | | | | | | 5 | | 12 |
| Magnesium fluoride | | | | | | | | 5 | | | | | |
| Fluorite | 5 | 5 | 5 | 5 | 10 | 5 | 10 | | 5 | | 3 | 7 | 7 |
| Exothermic materials | | | | | | | | | | | | | |
| Sodium carbonate | 10 | 10 | 10 | 10 | 10 | 15 | 5 | 4 | 10 | 15 | 4 | 4 | 4 |
| Sodium bicarbonate | | | | | 3 | | 5 | | 5 | 4 | | | |
| Sodium nitrate | 10 | 10 | 10 | | 7 | | 5 | | | 10 | | 6 | |
| Flame controlling material | | | | | | | | | | | | | |
| Iron oxide | 10 | 10 | | | 8 | | 5 | | | 8 | 10 | | |
| Reducing materials | | | | | | | | | | | | | |
| Silicon | 7 | 10 | 10 | | | 5 | | 5 | 10 | 8 | | 10 | 10 |
| Si-25 wt % Ca alloy | 7 | | | | 2 | | | | | 5 | 10 | | |
| Si-10 wt % Fe alloy | | | | | 6 | | | | | | | | |
| Graphite | | | | 5 | | 3 | 3 | | | | | | 2 |
| Coke | | | | 10 | | | | | | | | 1 | |
| Carbon black | | | | | 1 | 2 | 2 | 1 | | | 1 | 2 | 1 |
| Form | Powder | Powder | Powder | Granule | Powder | Powder | Powder | Powder | Powder | Powder | Powder | Powder | Powder |
| Chemical composition (wt %) | | | | | | | | | | | | | |
| $SiO_2$ | 39 | 36 | 37 | 28 | 27 | 32 | 31 | 40 | 40 | 35 | 33 | 47 | 41 |
| $Al_2O_3$ | 4 | 4 | 4 | 5 | 4 | 11 | 4 | 3 | 8 | 3 | 9 | 5 | 7 |
| $Fe_2O_3$ | 12 | 12 | 0.2 | 0.2 | 11 | 0.4 | 6 | 0.8 | 0.2 | 9 | 13 | 1 | 2 |
| CaO | 31 | 30 | 32 | 30 | 35 | 28 | 37 | 36 | 36 | 34 | 33 | 35 | 36 |
| MgO | 1 | 1 | 1 | 0.4 | 1 | 4 | 0.4 | 4 | 4 | 1 | 1 | 1 | 1 |
| $Na_2O + K_2O + Li_2O$ | 12 | 16 | 12 | 12 | 12 | 13 | 10 | 10 | 8 | 14 | 9 | 8 | 11 |
| F | 6 | 7 | 8 | 9 | 8 | 8 | 7 | 9 | 2 | 0.2 | 7 | 7 | 8 |
| F.C | 0.4 | 0.2 | 0.2 | 13 | 1 | 4 | 4 | 1 | 0.2 | 0.2 | 1 | 3 | 3 |
| $CaO/SiO_2$ | 0.8 | 0.8 | 0.9 | 1.1 | 1.3 | 0.9 | 1.2 | 0.9 | 0.9 | 1.0 | 1.0 | 0.7 | 0 |
| Use condition | | | | | | | | | | | | | |
| Kind of steel | Extremely low carbon | Extremely low carbon | Low carbon | High carbon | Middle carbon | Extremely low carbon | Middle carbon | Extremely low carbon | Low carbon | Low carbon | Extremely low carbon | Low carbon | Low |
| Tested amount | Front 8 try | Front 6 try | Front 10 try | Front 4 try | Front 5 try | Main 10ch each | Main 14ch | Main 8ch | Front 6 try | Front 7 try | Front 4 ry | Main 0.5ch | 1ch |
| Use results | | | | | | | | | | | | | |

TABLE 1-continued

| | Products of the invention | | | | | | | | | | Comparative products | | |
|---|---|---|---|---|---|---|---|---|---|---|---|---|---|
| | 1 | 2 | 3 | 4 | 5 | 6 | 7 | 8 | 9 | 10 | 1 | 2 | 3 |
| Workability | ◎ | ◎ | ○ | ◎ | ◎ | ◎ | ◎ | ◎ | ○ | ○ | ○ | Δ | Δ |
| Exothermic property | ◎ | ◎ | ◎ | ◎ | ◎ | ◎ | ◎ | ○ | ◎ | ◎ | Δ | Δ | Δ |
| Casting inclusion index | 1.0 | 1.1 | 0.8 | 0.3 | 0.5 | 0.4 | 0.2 | 0.7 | 1.4 | 1.2 | 4.2 | 6.8 | 8.4 |
| Casting pin-hole or blow-hole index | 1.0 | 1.1 | 0.7 | | 0.4 | 0.3 | 0.2 | 0.7 | 1.3 | 1.1 | 6.8 | 12 | 7.0 |
| Casting surface carbon pick-up | non | non | | | | | | | | | 18 ppm | | |
| Total evaluation | ◎ | ◎ | ◎ | ◎ | ◎ | ◎ | ◎ | ◎ | ◎ | ◎ | Δ | X | X |

Note:
In the table, blanks mean "not measured".
In the item of tested amounts, "Front" means mold additives used at the begining of casting, and "Main" means mold additives used at running state of casting.

TABLE 2

| | Products of the invention | | | | | | | Comparative products | |
|---|---|---|---|---|---|---|---|---|---|
| | 11 | 12 | 13 | 14 | 15 | 16 | 17 | 4 | 5 |
| Composition (wt %) | | | | | | | | | |
| Base raw materials | | | | | | | | | |
| Portland cement | 20 | 25 | | 29 | | | | | 55 |
| Blast furnace slag | | | 30 | 20 | | 20 | 40 | | |
| Synthetic calcium silicate | | | 19 | | 45 | 50 | | | |
| Yellow phosphorus slag | 40 | | | | 20 | | 37 | 61.7 | |
| Limestone | | 20 | 10 | 10 | | | | | |
| Silica type raw materials | | | | | | | | | |
| Fly ash | | | | 8 | | | | 3 | 20 |
| Diatomite | | 1 | | | 2 | 3 | | 5 | |
| Quartzite | 5 | | 3 | | | 3 | | 5 | |
| Sodium silicate | | | 8 | | 7 | | | | |
| Potassium silicate | | | 3 glass | 3 potassium silicate | | | | | |
| Flux raw materials | | | | | | | | | |
| Sodium fluoride | 5 | 5 | | | 11 | | 5 | 5 | 10 |
| Magnesium fluoride | 2 | | | | | | | | |
| Fluorite | 2 | 6 | | | 6 | | | 5 | 5.3 |
| Cryolite | 5 | | | | | 2 | | 5 | 6 |
| Exothermic materials | | | | | | | | | |
| Sodium carbonate | 8 | 2 | 2 | 6 | | 8 | 8 | 4 | |
| Sodium bicarbonate | | | 8 | 5 | 2 | 2 | | | |
| Sodium nitrate | | 4 | 2 | 6 | 2 | 2 | | | |
| Potassium carbonate | | 7 | | | | | | | |
| Potassium bicarbonate | | 2 | | | | | | | |
| Potassium nitrate | 2 | 6 | 4 | | | | | | |
| Lithium carbonate | 2 | | 6 | 7 | | 5 | | | |
| Reducing materials | | | | | | | | | |
| Silicon | 5 | 10 | 3 | 3 | 3 | 3 | 3 | | |
| Si-25 wt % Ca alloy | | 2 | 1 | 2 | | | | 6 | 3 |
| Si-10 wt % Fe alloy | | 6 | | | | | | | |
| Graphite | | 3 | | 1 | | 1 | 2 | 0.3 | |
| Coke | 2 | | | | 1 | | | | |
| Carbon black | 2 | 1 | 1 | | 1 | 1 | | | 0.7 |
| Form | Powder | Powder | Granule | Powder | Powder | Powder | Powder | Powder | Powder |
| Chemical composition (wt %) | | | | | | | | | |
| $SiO_2$ | 38 | 42 | 36 | 29 | 38 | 39 | 36 | 45 | 36 |
| $Al_2O_3$ | 4 | 3 | 5 | 7 | 5 | 2 | 8 | 4 | 5 |
| CaO | 34 | 32 | 29 | 34 | 35 | 37 | 36 | 36 | 40 |
| MgO | 2 | 1 | 3 | 23 | 3 | 1 | 3 | 1 | 1 |
| $Na_2O + K_2O + Li_2O$ | 13 | 13 | 9 | 8 | 8 | 12 | 11 | 9 | 10 |
| F | 8 | 5 | 1 | 0.2 | 3 | 10 | 6 | 9 | 10 |
| F.C | 3.6 | 3.7 | 0.9 | 0.9 | 1.9 | 1.9 | 1.7 | 0.3 | 0.7 |
| $CaO/SiO_2$ | 0.9 | 0.8 | 0.8 | 1.2 | 0.9 | 0.9 | 1.0 | 0.8 | 1.1 |
| Use condition | | | | | | | | | |
| Kind of steel | Extremely low carbon | Extremely low carbon | Extremely low carbon | Stainless | Stainless | Extremely low carbon | Extremely low carbon | Extremely low carbon | Stainless |
| Tested amounts | 5ch | 2ch | 3ch | 2ch | 4ch | 8ch | 1ch | 2ch | 1ch |
| Use results | | | | | | | | | |
| Workability | ◎ | ○ | ◎ | ◎ | ○ | ◎ | ◎ | Δ | X |
| Exothermic property (Insulating property) | ◎ | ◎ | ◎ | ○ | ○ | ◎ | ◎ | Δ | Δ |
| Casting inclusion index | 1.0 | 0.5 | 1.5 | | 2.5 | 1.0 | 1.2 | 16 | 10 |
| Casting pin-hole or blow-hole index | 1.0 | | 1.5 | 1.5 | 2.1 | 1.5 | 1.0 | 12 | 14 |
| Casting surface carbon pick-up | 1 ppm | 1 ppm | non | non | | | | 1 ppm | 1 ppm |
| Total evaluation | ◎ | ◎ | ◎ | ◎ | ○ | ◎ | ◎ | X | X |

Note:
In the table, a blank space means "not measured".

FEASIBILITY IN INDUSTRY

An exothermic mold additive for continuous casting of the present invention exhibits excellent workability and exothermic properties as a starting and running mold additive in various kinds of steel, and may provide a steel cast-piece with very few defects such as inclusions, pin-holes, etc. Particularly, the mold additive in which more than one kind of component is selected from a group comprising carbonates, bicarbonates and nitrates of alkaline metal as an exothermic material, and carbonaceous raw materials and silicon or silicon alloys or a mixture thereof as a reducing material are added and formulated, does not cause carburization, and has excellent insulating properties, and further, it does not cause contamination, etc. of steel by unreacted substances.

We claim:

1. An exothermic type mold additive for continuous casting which comprises 20~90 wt % base raw materials, 0~10 wt % silicious raw materials containing more than 50 wt % $SiO_2$ content, 0~20 wt % flux raw materials, 2~30% of more than one kind of component selected from the group consisting of carbonates, bicarbonates and nitrates of alkaline metals as exothermic materials, and 3~30 wt % of more than one kind of component selected from the group consisting of carbon, silicon and silicon alloys as reducing materials.

2. An exothermic type mold additive for continuous casting which comprises 20~90 wt % base raw materials, 0~10 wt % silicious raw materials containing more than 50 wt % $SiO_2$ content, 0~20 wt % flux raw materials, 2~30 wt % of more than one kind of component selected from the group consisting of carbonates, bicarbonates and nitrates of alkaline metals as exothermic materials, and 3~30 wt % silicon and/or silicon alloys, wherein inevitable free carbon is less than 0.5 wt %.

3. The exothermic type mold additive for continuous casting according to claim 1 or 2 wherein 0~30 wt % flame controlling materials comprising iron oxide are contained therein.

* * * * *